US012258175B2

(12) United States Patent
Shuert et al.

(10) Patent No.: US 12,258,175 B2
(45) Date of Patent: Mar. 25, 2025

(54) CLIP FOR FORMING PASSIVE LOCKS BETWEEN CONTAINER SLEEVES AND BASES

(71) Applicant: Shuert Technology, LLC, Sterling Heights, MI (US)

(72) Inventors: Matthew C. Shuert, Sterling Heights, MI (US); Jeffrey C. Jurcak, Shelby Township, MI (US)

(73) Assignee: Shuert Technology, LLC, Sterling Heights, MI (US)

( * ) Notice: Subject to any disclaimer, the term of this patent is extended or adjusted under 35 U.S.C. 154(b) by 185 days.

(21) Appl. No.: 17/981,393

(22) Filed: Nov. 5, 2022

(65) Prior Publication Data

US 2023/0053376 A1 Feb. 23, 2023

Related U.S. Application Data

(62) Division of application No. 16/721,374, filed on Dec. 19, 2019, now Pat. No. 11,542,061.

(Continued)

(51) Int. Cl.

*B65D 19/02* (2006.01)
*B65D 19/18* (2006.01)
*B65D 19/38* (2006.01)

(52) U.S. Cl.

CPC ..... *B65D 19/38* (2013.01); *B65D 19/18* (2013.01); *B65D 2519/00034* (2013.01); *B65D 2519/00069* (2013.01); *B65D 2519/00174* (2013.01); *B65D 2519/00208* (2013.01); *B65D 2519/00268* (2013.01); *B65D 2519/00288* (2013.01); *B65D 2519/00318* (2013.01); *B65D 2519/00338* (2013.01); *B65D 2519/00497* (2013.01);

(Continued)

(58) Field of Classification Search

CPC ..... Y10T 24/44017; Y10T 24/44026; B65D 2519/00711; B65D 2519/00661; B65D 2519/00537; B65D 2519/00497; B65D 2519/00338; B65D 2519/00318; B65D 2519/00288; B65D 2519/00268; B65D 2519/00208; B65D 2519/00174; B65D 2519/00069; B65D 2519/00034; B65D 19/18; B65D 19/38

See application file for complete search history.

(56) References Cited

U.S. PATENT DOCUMENTS 5,123,541 A 6/1992 Giannini et al.
5,862,917 A 1/1999 Noble et al.
2006/0032029 A1* 2/2006 Nessel ..... F16B 5/065 24/289

* cited by examiner

*Primary Examiner* — David M Upchurch
*Assistant Examiner* — Michael S Lee
(74) *Attorney, Agent, or Firm* — Young Basile Hanlon & MacFarlane, P.C.

(57) ABSTRACT

A molded plastic clip for attachment to the edge of a container sleeve to form part of a passive lock operable between the sleeve and a base structure such as a molded plastic pallet having a peripheral groove for receiving the edge of the panel. The clip comprises a molded plastic body having two generally planar panels joined at one end by a double hinge that allows the panels to be folded into a parallel condition spaced apart by the geometry of the double hinge wherein the inner surfaces of the panels are provided with integral male and female snap lock features and an outer panel is provided with an integral protruding tab feature near the double hinge to fit into a locking slot or opening in the structure groove. The clips are used in multiples.

15 Claims, 19 Drawing Sheets

Related U.S. Application Data

(60) Provisional application No. 62/863,511, filed on Jun. 19, 2019.

(52) U.S. Cl.
CPC ..... *B65D 2519/00537* (2013.01); *B65D 2519/00661* (2013.01); *B65D 2519/00711* (2013.01)

CLIP FOR FORMING PASSIVE LOCKS BETWEEN CONTAINER SLEEVES AND BASES

CROSS-REFERENCE TO RELATED APPLICATION

This application is a divisional claiming the benefits of U.S. Provisional Ser. No. 62/863,511 filed on Jun. 19, 2019 and U.S. patent Ser. No. 16/721,374 filed on Dec. 19, 2019 the content of which is incorporated herein by reference.

FIELD OF THE INVENTION

The invention described herein is in the field of shipping containers of the type having molded plastic top and bottom members removably attached to and enclosing the open ends of a foldable sleeve that forms the sidewalls of a container. Passive mechanisms; i.e., mechanisms that do not require direct operator interaction, are used to secure and remove the top and bottom members to and from the sleeve.

BACKGROUND OF THE INVENTION

U.S. Pat. No. Re. 35,875, issued Aug. 25, 1998 to Lyle H. Shuert of Bloomfield Hills, Michigan, discloses a container comprising the combination of a four-sided foldable corrugated sleeve and a pair of identical molded plastic members, shaped to act as forklift truck compatible pallets, attached to the top and bottom edges of the sleeve respectively, by means of hand operated slide latches. The slide latches include elongate plastic members movable by direct hand action between extended and retracted positions relative to slots formed in the sleeve near the top and bottom edges. When the latch members are extended, they fit into the slots to hold the sleeve and pallets together.

SUMMARY OF THE DISCLOSURE

As described herein, a three-part container generally of the type described in the Reissue patent is improved by the substitution of a passive locking arrangement for the slide lock latches. By "passive," we mean that the locking arrangement allows the sleeve sidewalls to be securely attached to top and bottom molded plastic members by simple insertion of the sleeve edges and without the necessity for moving components of latch devices by direct hand action. The bottom member can be a pallet with legs arranged to be compatible with a forklift truck for handling purposes. The top member may be of a different configuration to simply act as a cover but may, if desired, be identical to the bottom pallet.

As illustrated, the bottom pallet and the top cover are each constructed in a four-sided configuration with a peripherical rim forming the outside wall of a continuous groove that receives the edges of a four-sided sleeve therein. The four-sided configuration is merely illustrative as other shapes are possible. In the first of two disclosed embodiments, fixed lock tabs are integrally formed in the peripheral rim of the pallet and cover so as to extend inwardly across the sleeve edge-receiving groove in locations chosen to fit into slots formed such as by die cutting in the sidewalls of the sleeve near the top and bottom edges.

Relief areas or depressions are molded into the interior decks of the pallet and cover immediately across from the fixed tabs to provide clearances that allow inward flexing of the sleeve side walls during insertion and removal thereof relative to the pallet and cover grooves.

In all disclosed embodiments, the tabs are shaped with sloped top and bottom surfaces to act as a cam on edges of the sleeve and/or a sleeve slot during insertion and removal. In addition, the tabs are wedge-shaped with rounded outside edges.

The bottom pallet is preferably configured with nine feet which are integral with the pallet deck and rim, one foot at the middle of each side, and the ninth foot in the center of the deck. This makes the pallet compatible with forklift trucks and provides four-way entry.

In a second embodiment herein disclosed, the locations of the tabs and slots are reversed; i.e., fixed lock tabs are located on the sleeve and the "slots" are in the pallet and cover but are preferably formed as pockets. The tabs may be formed as clips attached to the sleeve sidewalls. Again, the tabs are sloped on top and bottom surfaces to facilitate insertion and removal of the sleeve tabs into and from the pockets.

In all disclosed embodiments, the tabs are shaped with sloped top and bottom surfaces to act as a cam on edges of the sleeve and/or a sleeve slot facilitating both insertion and removal. In addition, the tabs are wedge-shaped with a rounded or elliptical outside edge.

The cover and pallet may be of hollow twin-sheet construction. The cover has bosses formed in the inner deck surface for rigidity. In the disclosed embodiments, the lock tabs and slots associated with the sleeve are provided on only two sides at the top because the sleeve has deep cutouts on two sides for access and/or inspection purposes. However, these cut-outs are illustrative only; i.e., the sleeves can have solid, unbroken sides, in which case there can be locks on each side of the sleeve, both top and bottom.

DETAILED DESCRIPTION OF THE ILLUSTRATIVE EMBODIMENTS

Figure 1:
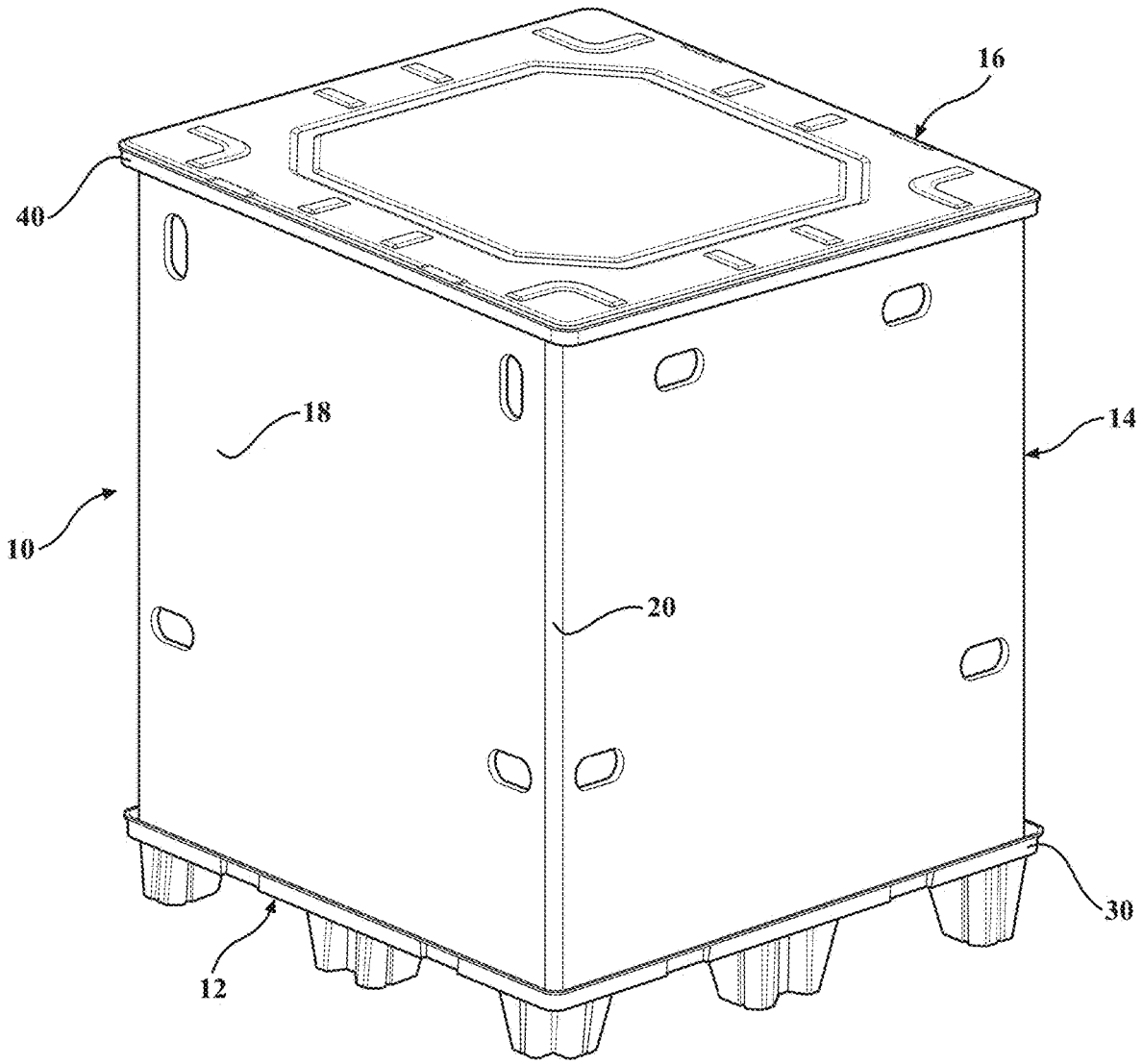
FIG. 1 is a perspective view of an assembled container comprising a pallet bottom, a cover, and a sleeve with cutouts in two sides.
Figure 3:
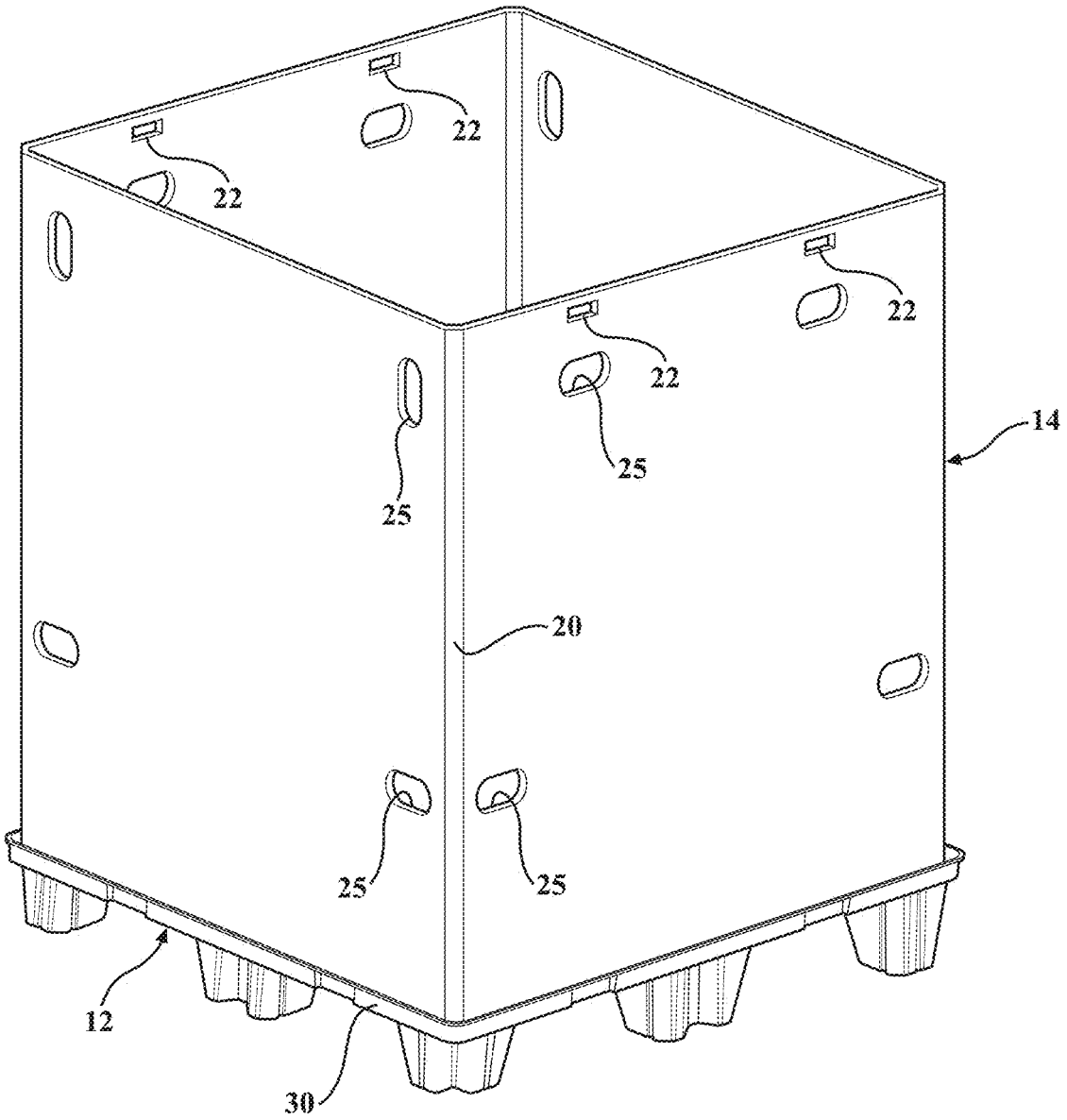
FIG. 3 is a perspective view of a sleeve attached to a bottom pallet and with top cover removed.
Figure 4:
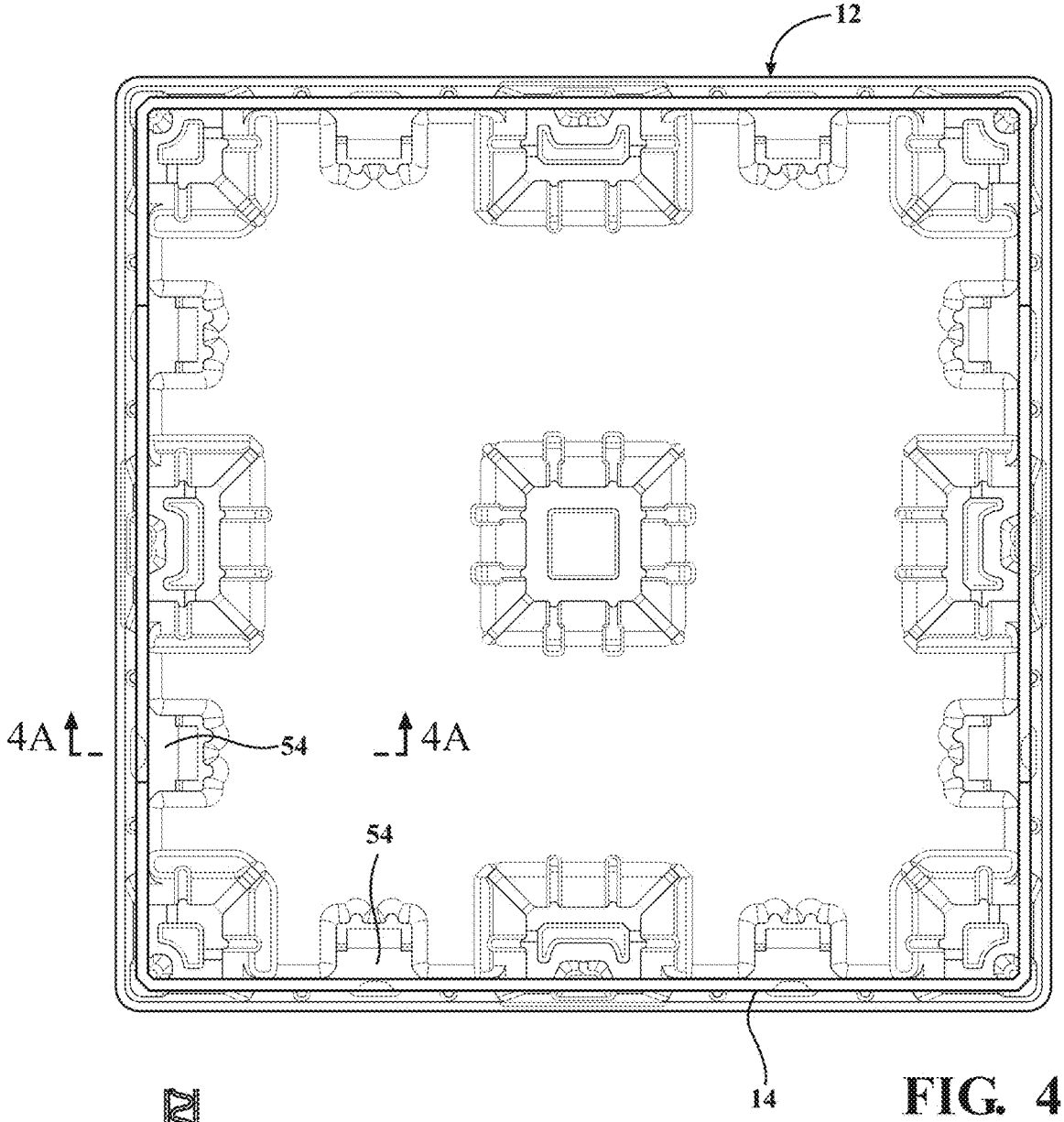
FIG. 4 is a top plan view of a pallet with a sleeve inserted and locked into a peripheral groove.
Figure 4A:
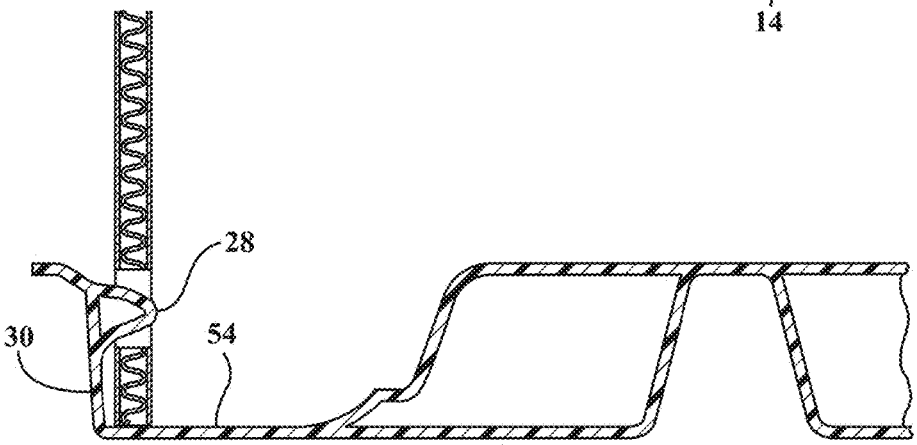
FIG. 4A is a partial sectional view of a pallet with a section through an inserted sleeve.
Figure 5:
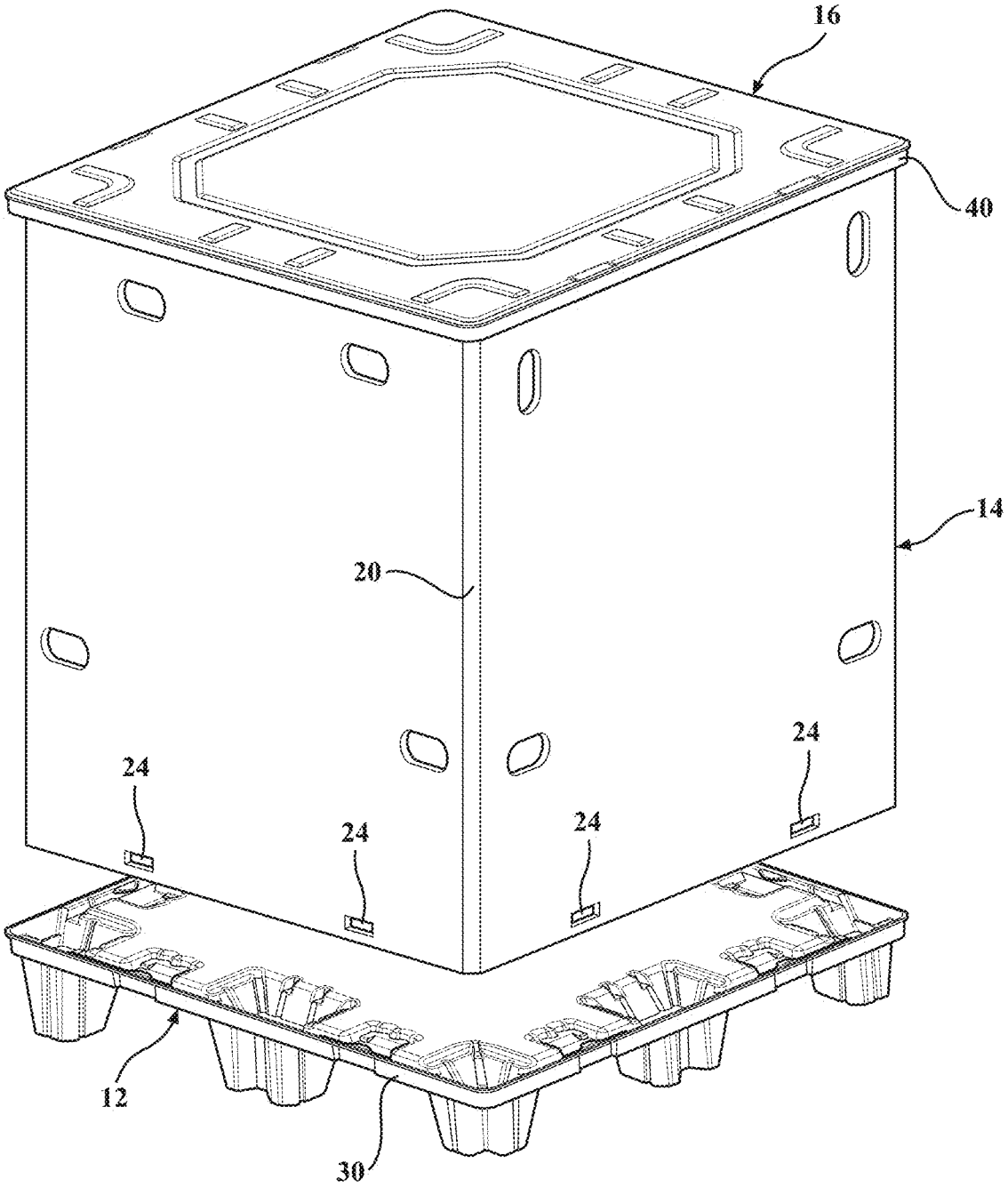
FIG. 5 is a perspective view of a container with the sleeve separated from the pallet but with an installed molded plastic cover.

Referring to FIG. 1, an assembled container 10 is disclosed. The container 10, in all disclosed embodiments, comprises three principal parts, a molded plastic bottom pallet 12 compatible with forklift handling, a foldable four-sided sleeve 14 of corrugated organic material or the like, and a molded plastic top cover 16. Two sides of the sleeve have cutouts 18 extending to opposite top edges while the other two sides are solid. These cutouts are optional; i.e., all four sides of the sleeve may be solid. The pallet 12 and cover 16 can be vacuum-assist thermoformed of polyethylene or other suitable polymer while the sleeve 14 can be constructed of corrugated paperboard, preferably treated for waterproofing, or any other suitable material with fold joints 20 at the four vertical corners between side panels. The material thickness is chosen such that the side panels exhibit a degree of flexibility and may be die cut to form slots 22 and 24 adjacent the top and bottom edges, respectively, as shown in FIGS. 3 and 5. Additional slots or openings 25 may be formed in the sleeve 14 for handling purposes as desired.

Detailed Description of the First Embodiment

Figure 11:
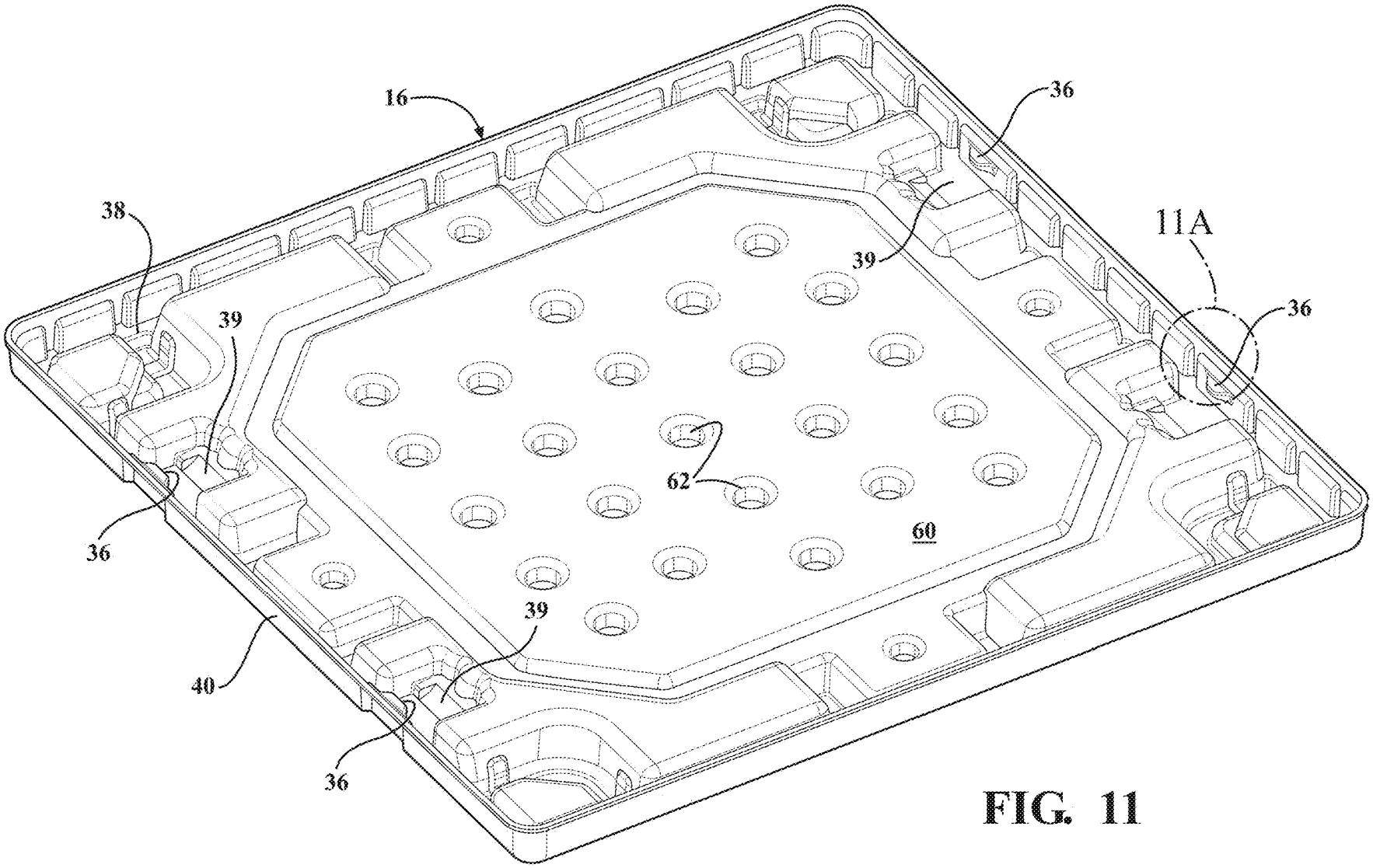
FIG. 11 is a perspective view of a cover bottom side.
Figure 11A:
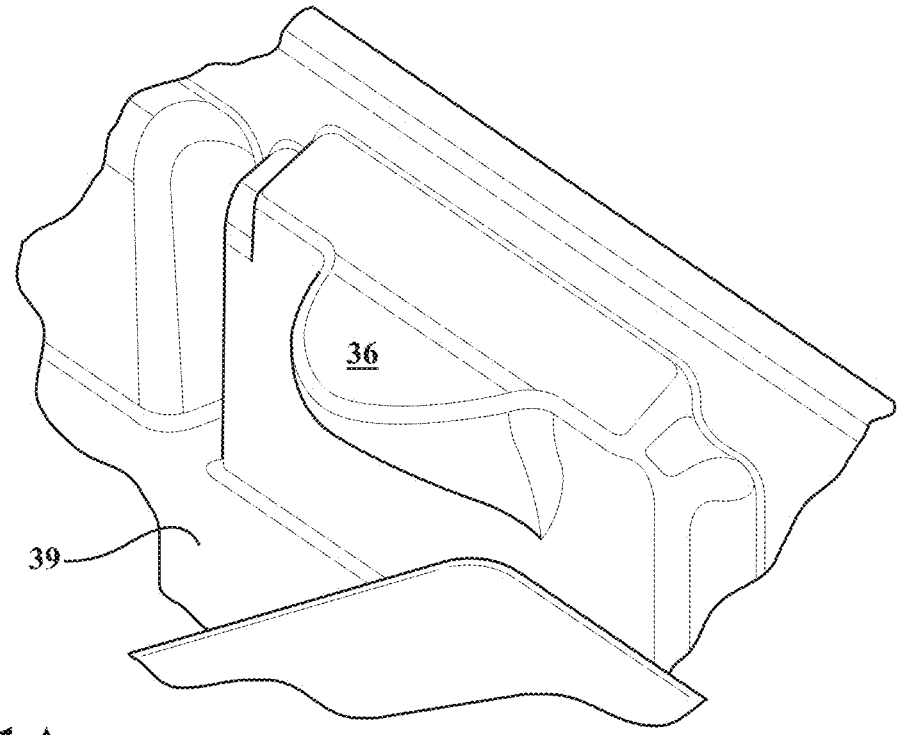
FIG. 11A is a detail of a locking tab in the cover.

The first embodiment is shown in FIGS. 2, 3, 4, 4A, 5-11A and corresponds essentially to what is shown in FIG. 1 as far as the three major components are concerned. It includes passive locks comprising tabs 26 in locations that correspond to the locations of slots 24 that are cut into the side walls of the sleeve 14. As a result, the tabs 26 fit into the slots 24 to secure the sleeve 14 to the pallet 12 simply by pushing the properly configured sleeve bottom edge into a groove 28 formed around the periphery of the pallet 12 inside of a surrounding rim 30. A similar arrangement is provided at the top of the combination to secure the cover 16 to the top edge of the sleeve 14. This includes the slots 22 in the solid sides of the sleeve and tabs 36 molded into the interior wall of a groove 38 inside of a rim 40 extending around the outside of the cover 16 as shown in FIGS. 11 and 11A. Here, tabs 36 are formed on only two sides of the cover because there are no slots in the sleeve on two of the sides. However, in a container having a sleeve with no cutouts 18, slots and tabs can be provided on all four sides. Again, the locations of the tabs 36 and slots 22 are chosen to coincide so the tabs fit into the slots when the cover 16 is pushed down on the top of the sleeve edge.

Figures 2, 2A:
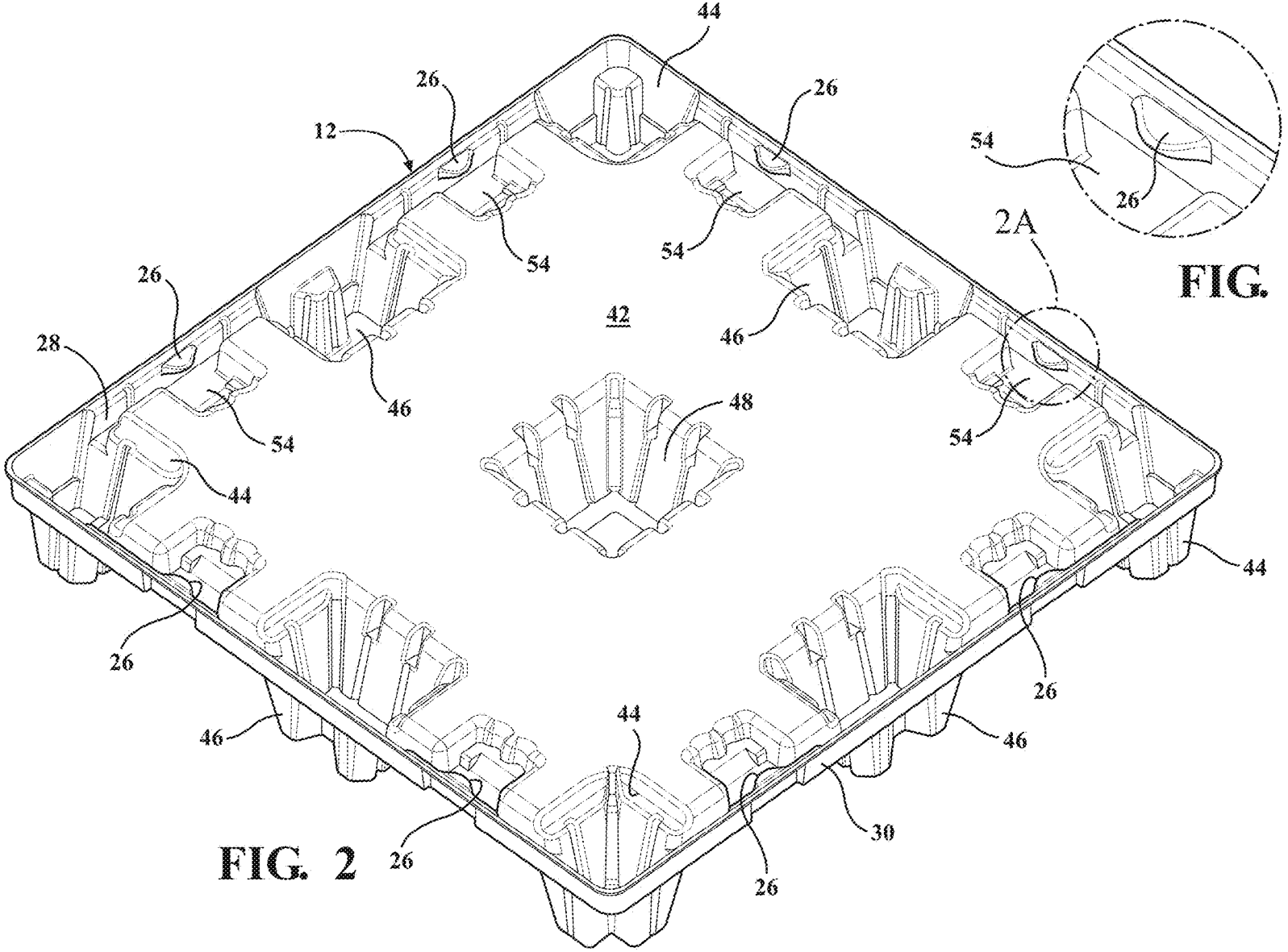
FIG. 2 is a perspective view of the pallet bottom showing the legs, peripheral rim sleeve-receiving groove and locking tabs.
FIG. 2A is a detail of a locking tab formed on the inside surface of the pallet rim and extending inwardly toward a relief area.

Looking specifically to FIGS. 2 and 2A, the bottom pallet 12 can be vacuum thermoformed, preferably out of single sheet of material, to produce a central general flat deck 42, tapered feet 44 in each of the four corners of the pallet bottom 12, a tapered foot 46 midway in each of the four sides, and single center foot 48. All of the feet are thermoformed using a die and vacuum to draw the polymeric sheet material into cavities in the die after the material has been heated to make it flow more readily. The feet are provided with vertical side grooves for additional strength and rigidity as will be apparent to persons of ordinary skill in the vacuum thermoforming art.

Figure 6:
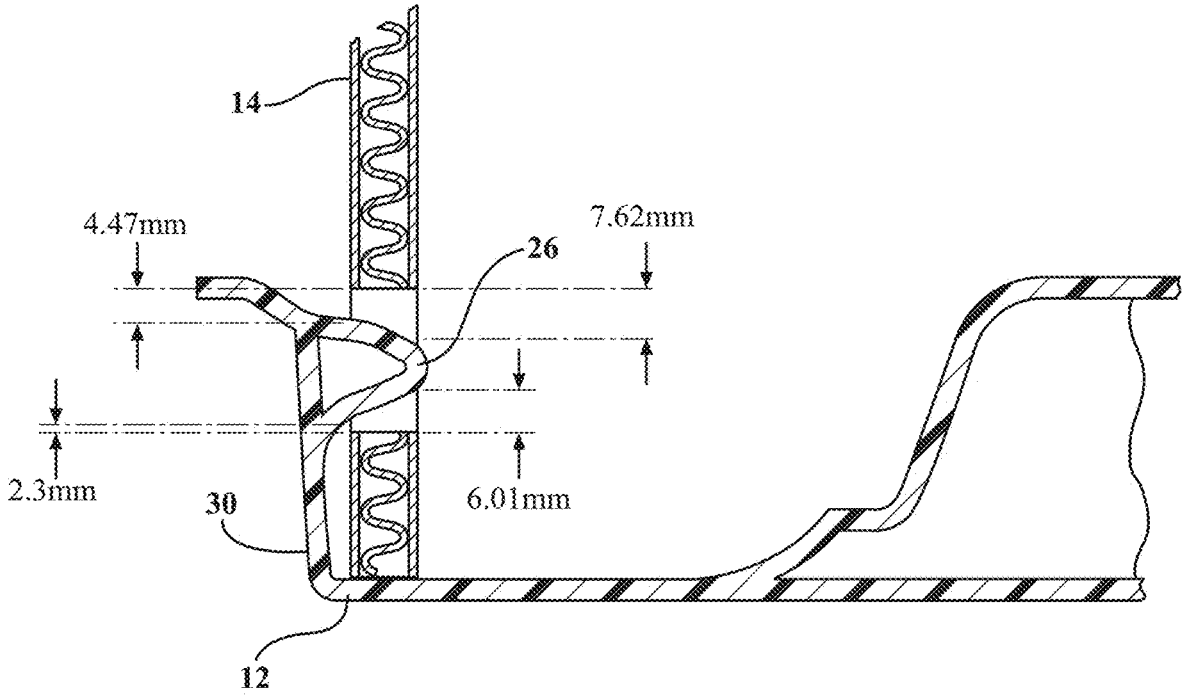
FIG. 6 is similar to FIG. 4 but with illustrative dimensions.

The peripheral rim 30 runs continuously around all four sides of the pallet to define the continuous peripheral groove 28 which is dimensioned and configured to receive therein the entire bottom edge of the sleeve 14 after the sleeve has been unfolded and reconfigured as a four-sided body. The depth of the groove 28 is such that lock tabs 26 enter slots 24 in the sleeve 14 when the bottom edges of the sleeve engage the bottom of the groove as shown in FIG. 6. This is important in that it is desirable, especially when loaded containers are stacked, to transfer stacking loads down through the sleeve and the pallet feet to the floor on which the bottom pallet sits.

Figure 7:
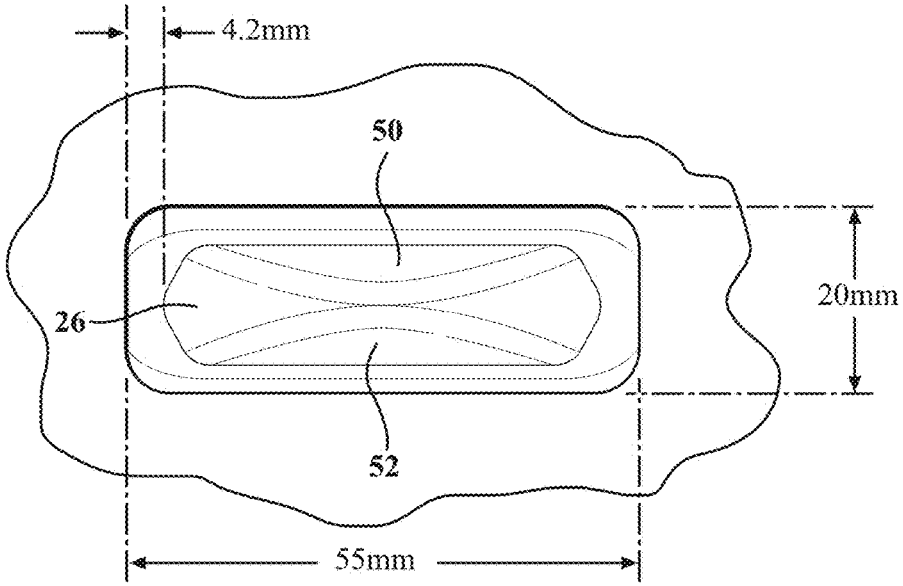
FIG. 7 shows a locking tab with illustrative dimensions.
Figure 8:
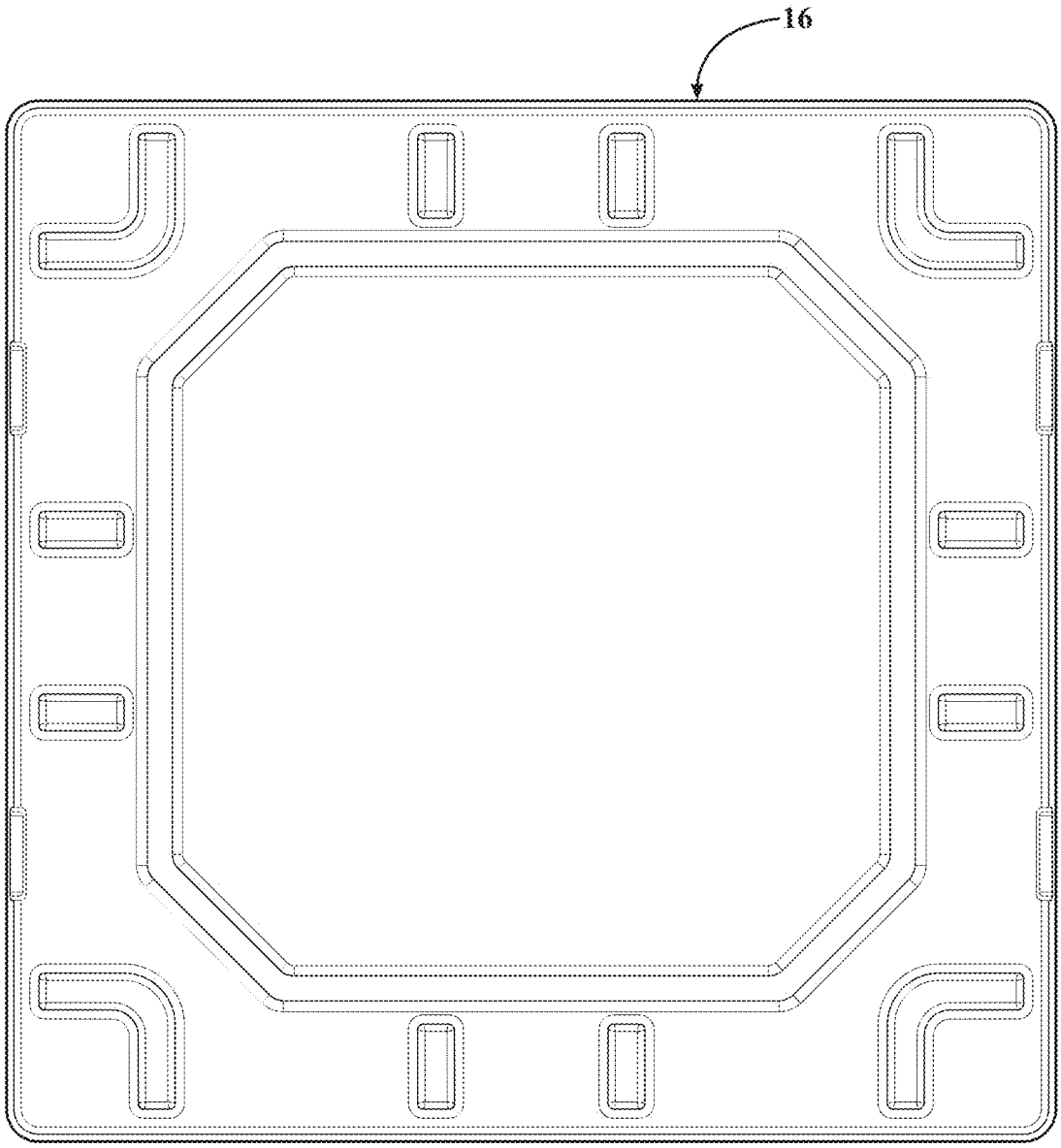
FIG. 8 is a plan view of a cover.

As shown in FIGS. 2, 6, and 7, each of the locking tabs 26 and 36 is wedge-shaped and has a semi-circular outside edge. The tabs 26 and 36 also have sloped top and bottom surfaces 50 and 52 to act as cams during insertion and removal of the sleeve into the groove and, in particular, while the locking tabs encounter the bottom edge of the sleeve (during insertion) and the bottom edge of the slots 24 during removal.

To aid in the insertion and removal steps, a box-shaped relief or depression 54 is formed in the pallet surface 42 directly opposite each of the locking tabs 24 in the groove 28 as shown in FIGS. 2 and 2A. The floor of each relief 54 coincides with the bottom of the groove 28 in FIG. 4A to provide space into which the wall of the sleeve 14 can flex during insertion and removal steps. The groove 28 is otherwise narrow enough to prevent excessive play between the sleeve and the pallet.

The Cover

The embodiment here described further comprises a molded plastic cover 16 which, to a great extent, mirrors the bottom pallet 12 with the exception that the cover in this example is less deep and has no feet. As shown in FIGS. 9-11A, the cover 16 is formed with a continuous groove 56 inside of a peripheral rim 40 to receive the top edge of the sleeve 14 for assembly purposes.

As shown in FIGS. 1 and 5, the cover 16 fits onto the top edge of the sleeve 14 and is pushed down until all of the locking tabs 36 enter into the slots 22 to lock the cover in place.

As shown in FIGS. 9, 10, 11, and 11A, reliefs 39 are formed in the cover directly opposite the locations of the tabs 36 to provide space into which the sleeve material can flex during the insertion and removal steps. The floors of the reliefs are on the same level as the groove 38 so that the tabs 36 are above the relief floor when the cover is inserted as shown.

As shown in FIG. 11, the cover 16 has an interior deck 60 with bosses 62, a peripheral groove 38 bordered by a rim 40 that extends around the entire cover. The lock tabs 36 are molded into the inside surface of groove 38 as shown in FIG.

Figure 9:
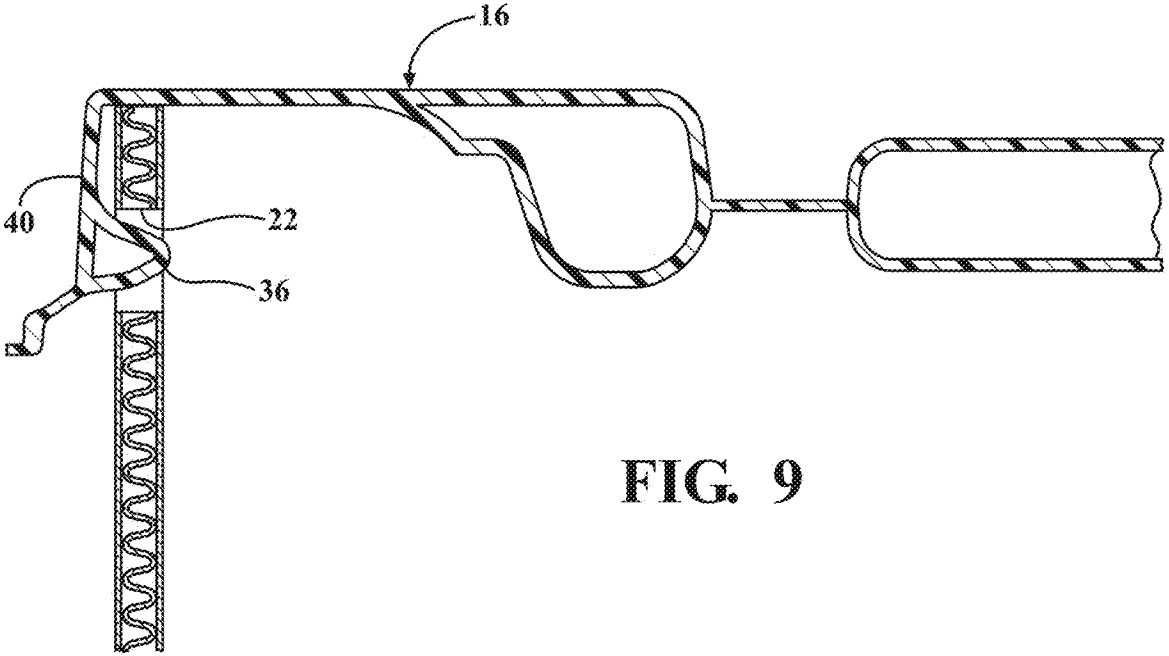
FIG. 9 is a partial view in sections of a twin sheet cover with a locking tab inserted into a sleeve slot.
Figure 10:
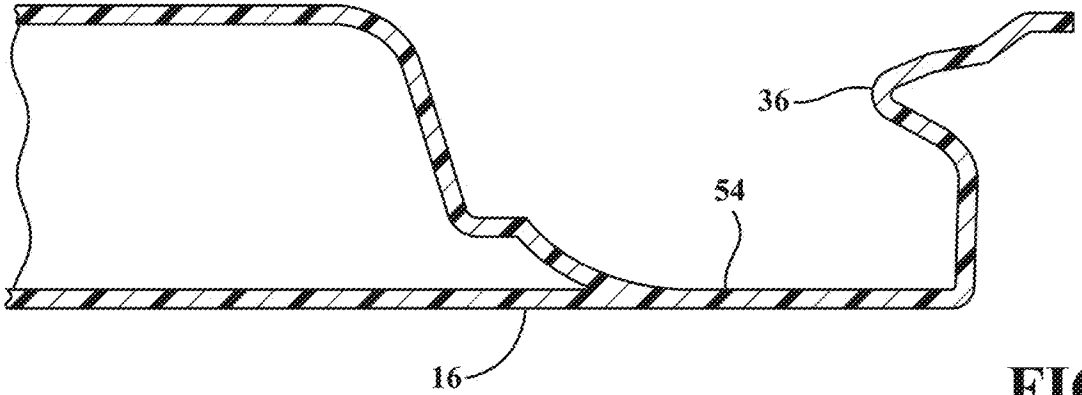
FIG. 10 is a sectional view of a single sheet lock tab clip for attachment to a sleeve top or bottom edge.

9A. The cover tabs 36 may be of twin sheet construction as shown in FIG. 9 or single sheet per FIG. 10.

Detailed Description of the Second Embodiment

The second embodiment is generally similar to the first embodiment described above and also corresponds to the overall view as shown FIG. 1. The major difference is that the locations of the locking tabs and receiver slots are reversed; i.e., the locking tabs are located on the sleeve and the "pockets" that receive the tabs are in the pallet and cover. The overall function is the same as in the first embodiment; i.e., the container is assembled by pushing the sleeve bottom edge into the pallet groove and pushing the cover down on the sleeve top edge after filling the container. Disassembly is done in reverse order. The tabs are created using molded plastic, foldable clips 60 that are installed on the sleeve 14 whereas the receiver slots are formed as pockets 62 in the structures of the pallet and cover to receive clip tabs 64 and provide the locking operation. In other respects, the two embodiments are essentially the same.

Figure 12:
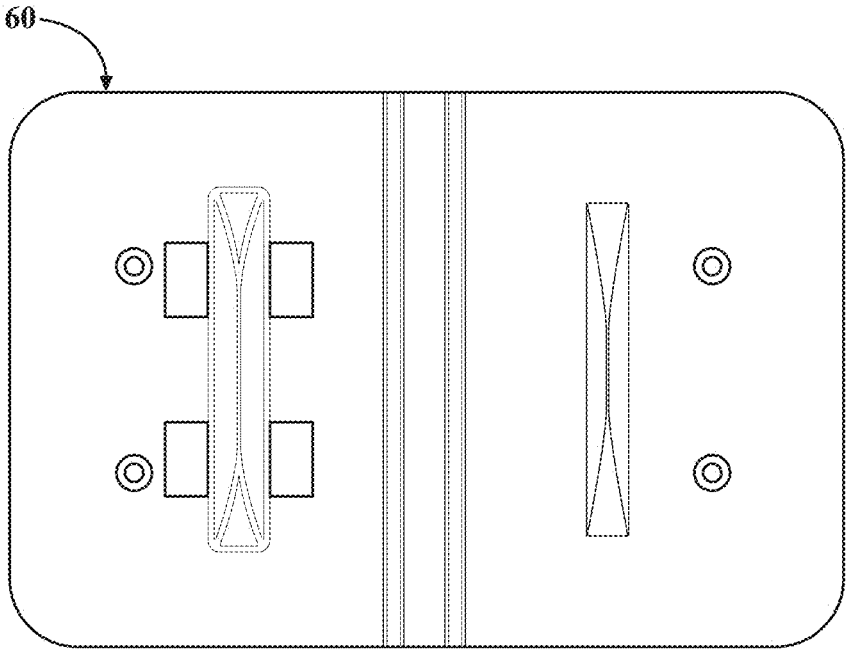
FIG. 12 is a sectional view of a foldable lock tab clip for attachment to a sleeve edge.
Figure 14:
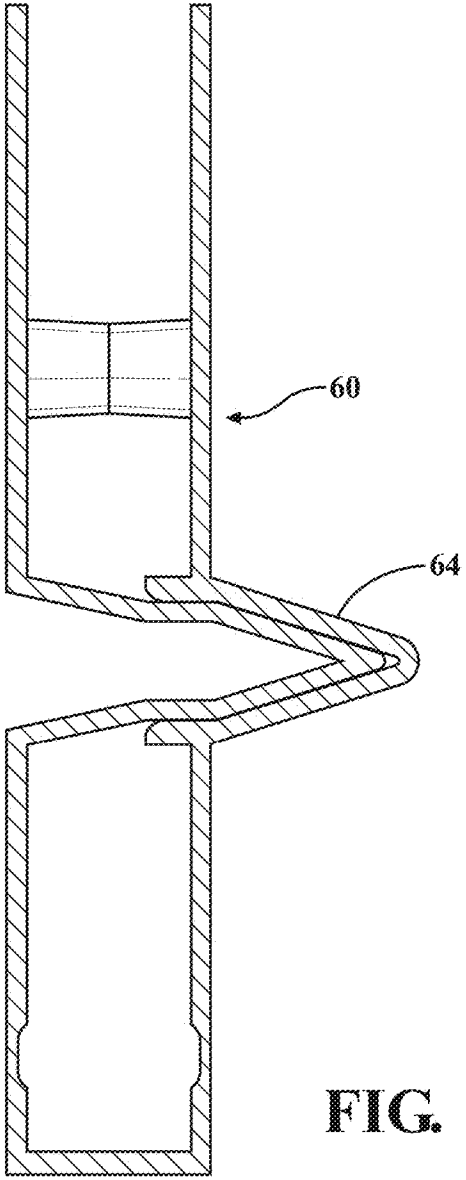
FIG. 14 is a sectional view of a folded tab clip.
Figure 13:
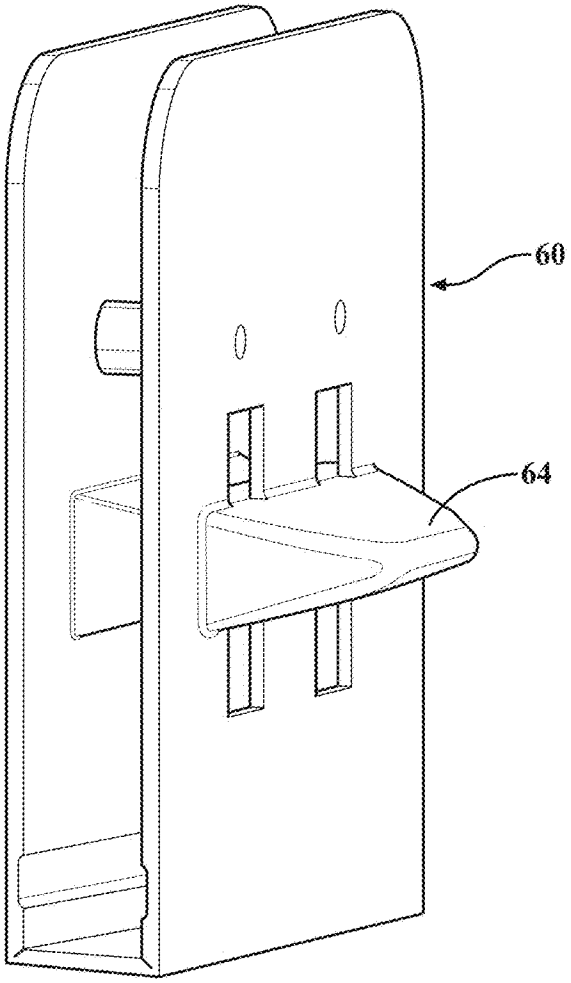
FIG. 13 is a perspective view of a foldable sleeve clip.
Figure 18:
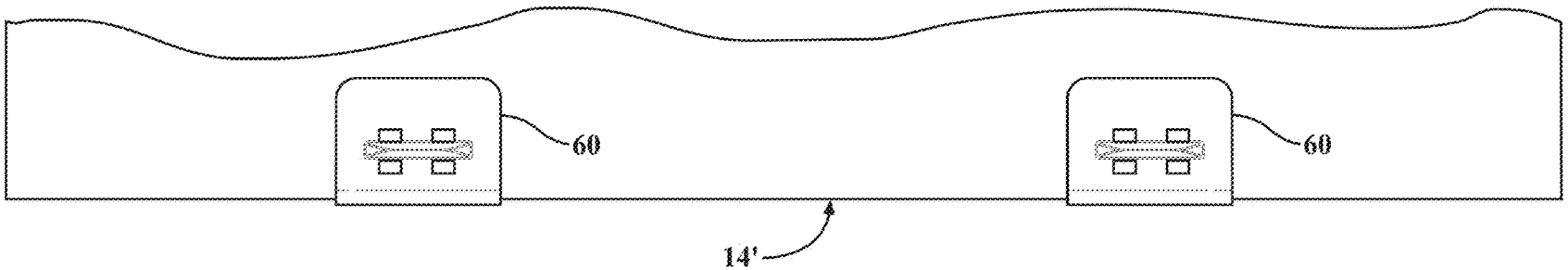
FIG. 18 shows clips attached to a sleeve bottom edge.

Referring to FIGS. 12-14, there is shown a foldable clip structure 60 of molded plastic which is used to create double-ply locking tabs 64 along the top and bottom edges of a sleeve 14'. These locking tabs, once the clips 60 are installed in the proper locations, fit into pockets 62 that are molded into the groove of the pallet and the cover, a pocket 62 in the pallet being shown in FIG. 20. Holes are die cut into the sleeve 14' at the proper locations to coincide with the location of the clip features that extend through the sleeve material. The clips have double fold lines 66 that are spaced apart by approximately the thickness of the sleeve so the clips can be folded to bring male tab 65 into the female tab 64 on the opposite side of the clip 60 and the clip 60 is thereby attached to the sleeve as shown in representative drawing FIG. 18.

Figure 15:
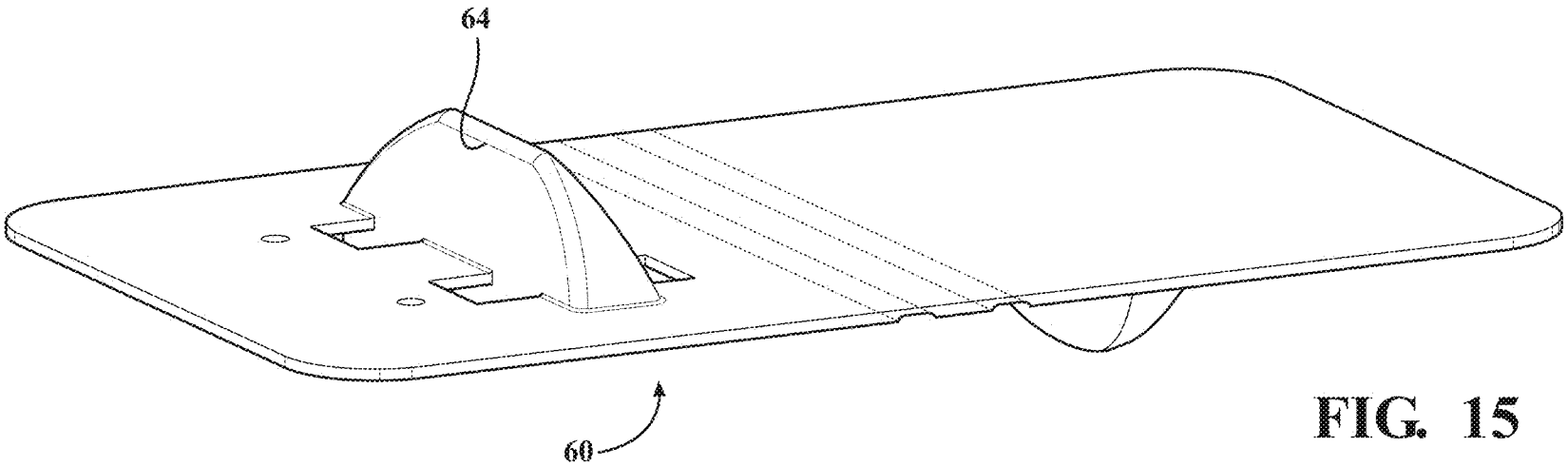
FIGS. 15-17 are views of a foldable lock tab clip for attachment to a sleeve edge.
Figure 16:
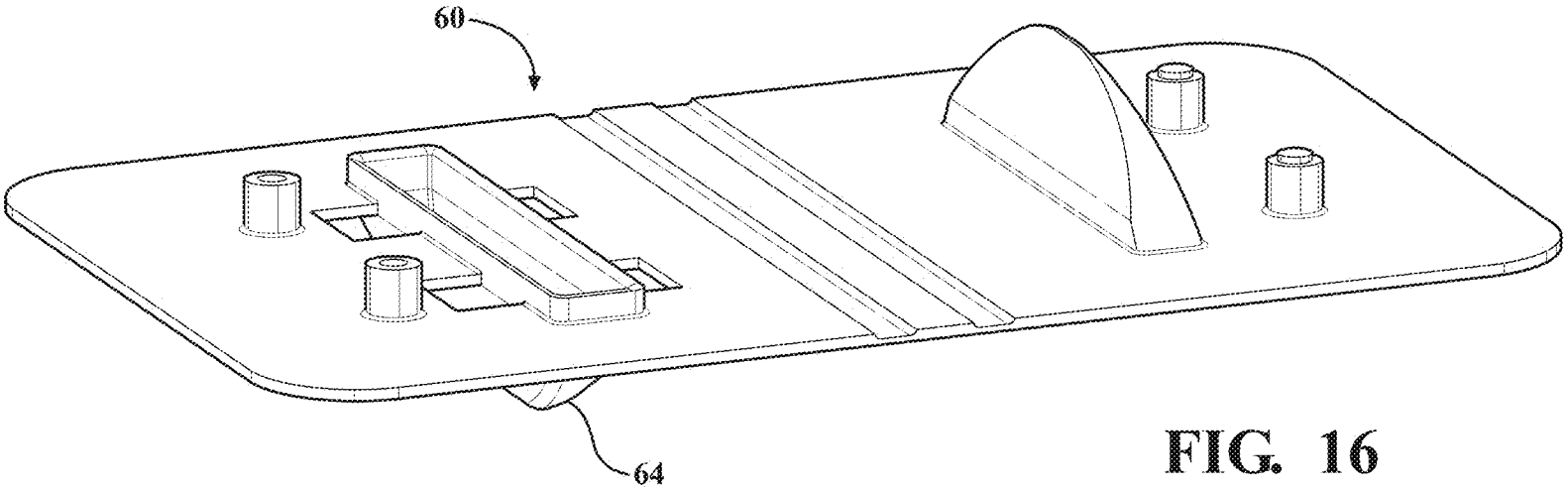
Figure 17:
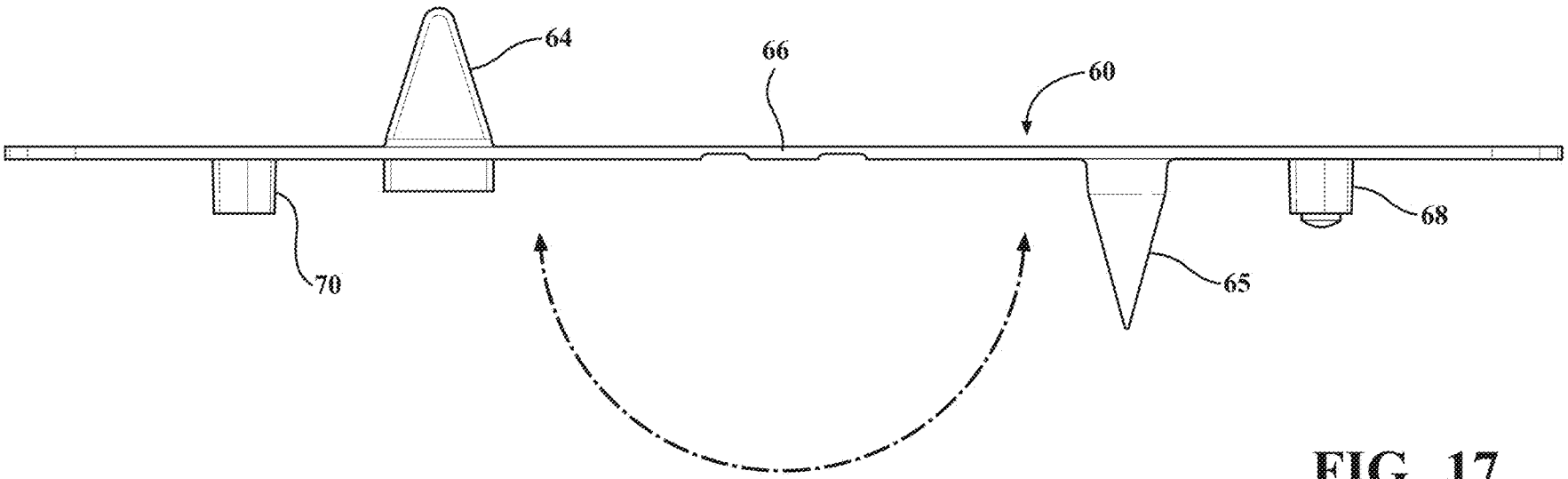

FIGS. 15, 16, and 17 illustrate the clip 60 and show male and female locking buttons 68 and 70 respectively that snap together to hold the clips together when assembled to a sleeve edge. An adhesive may be used to cement the clips in the folded/applied condition.

It will be understood that the terms "lock" and "locking" as used herein to define the relationship between the sleeve, pallet, and cover when joined by the tabs and slots/pockets, refers to a fastening protocol that, while secure, is achieved and removed without the need to manually move a bolt or slide latch into a keeper or to use tools for operation.

Figure 20:
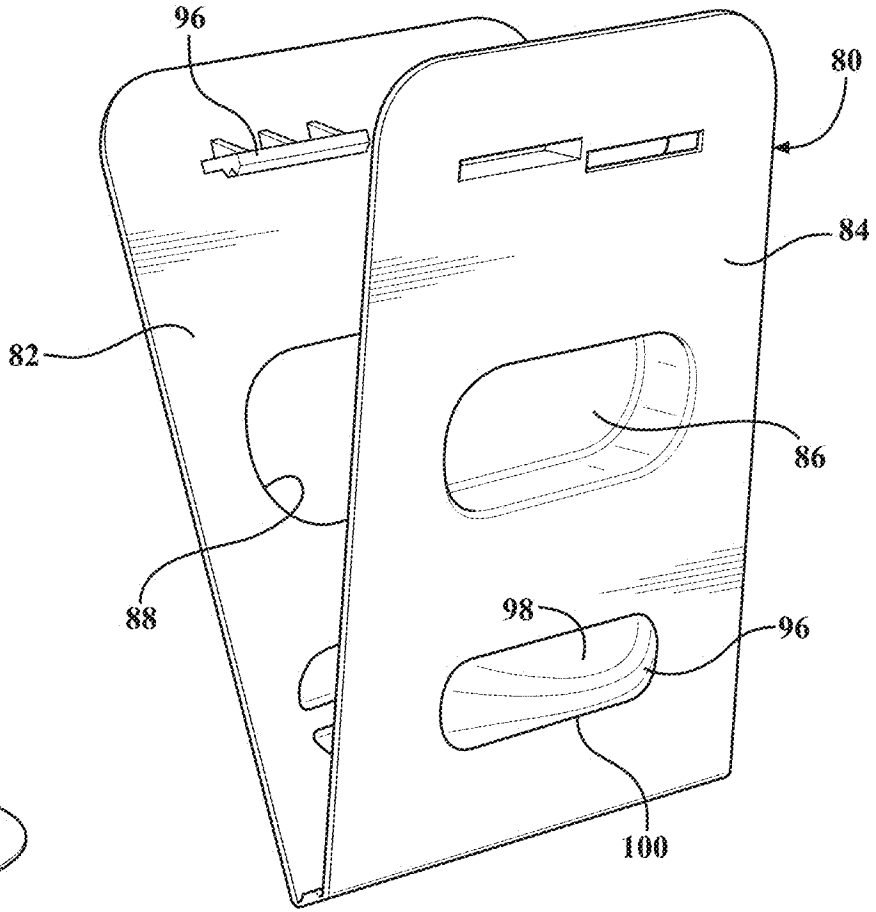
FIG. 20 shows a detail of a pallet pocket.
Figure 19:
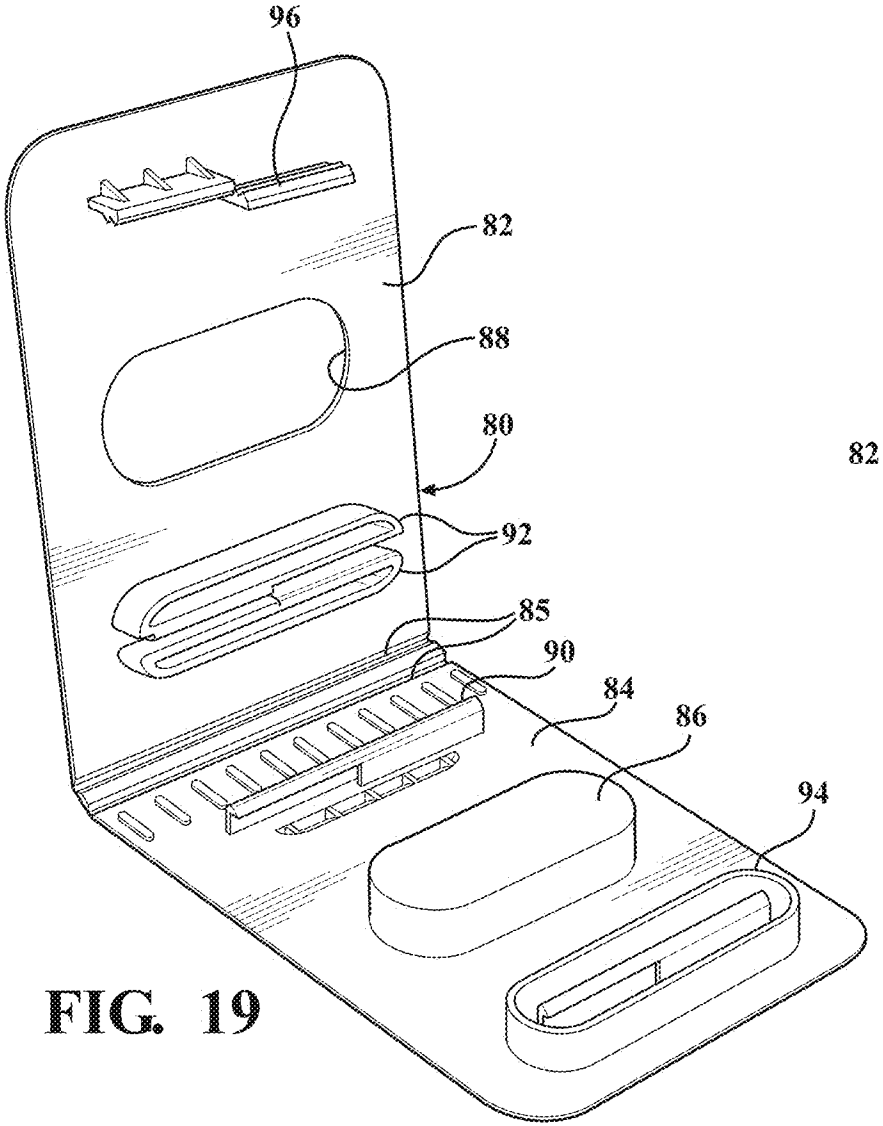
FIG. 19 shows a tab clip inserted into a pallet pocket.
Figure 21:
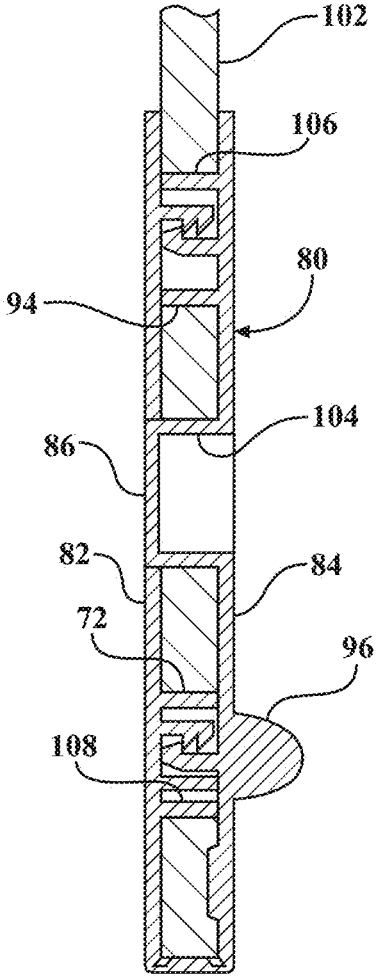
FIG. 21 is a sectional view of the clip of FIGS. 19 and 20 attached to a container sleeve.
Figure 23:
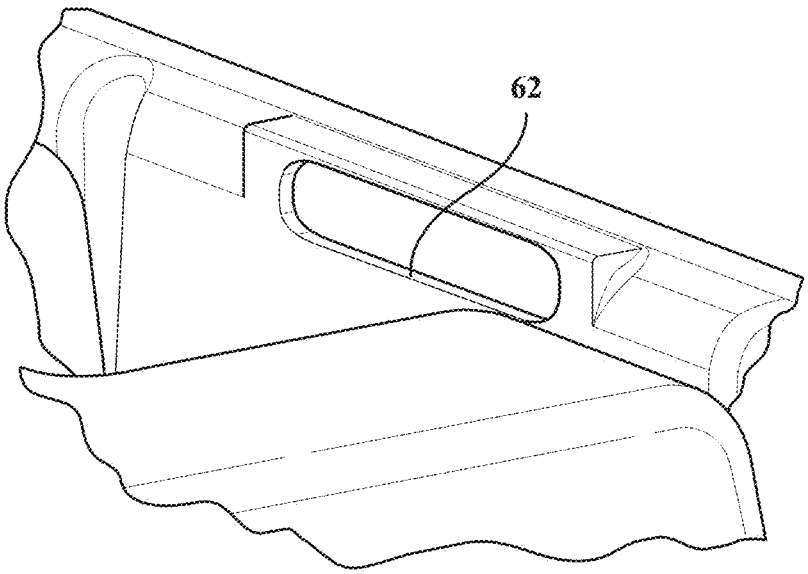
FIG. 23 is a detail of the clip-tab-receiving aperture in the pallet.

Referring now to FIGS. 19-26, an additional configuration of the foldable plastic clip 80 is shown. In these figures, the clip 80 is formed of a plastic material such as polyethylene to have two panels 82 and 84 joined by an integral double hinge 85 which permits the two panels to be folded essentially as shown in FIG. 20 into a parallel configuration to sandwich the sleeve material 102 between them as shown in FIG. 21. The double hinge 85 is configurated with two hinge lines far enough apart to accommodate the thickness of the sleeve between them, e.g., 9 mm to 11 mm. In addition, the sleeve is configured to fold flat accordion-style by means of center fold lines 83 in two of the four panels.

Clip panel 84 has formed in the inside surface thereof an oblong protrusion 86 which fits into a hole 88 in the panel 82 to firmly locate the two panels 82 and 84 relative to one another when the panels are folded into a parallel configuration and locked together as hereinafter described. As shown in FIG. 21 a hole 104 is formed in the sleeve to accommodate the protrusion 86 as it makes its way into the elongate aperture 88 in panel 82.

In addition, panel 84 has formed on the inside surface thereof a male locking mechanism 90 on one side of the protrusion 86 and a female locking receptacle 94 on the other side of the protrusion 86. Opposite gender elements 92 and 96 are formed integrally on the inside surface of the panel 82; i.e. a female locking mechanism 92 is configured to receive a male locking element or barb 90 on the opposite panel in a locking relationship therein. It will be noted that the male element has staggered insertion surfaces; i.e. one element being extended in one direction and the other element in the other direction and the female locking receptacle 92 is similarly configured to have undercut recesses of opposite configuration that are staggered so that when the male elements 90 fit therein they lock together. Again, a hole 108 is formed in the sleeve to allow passage of the locking elements therethrough.

In a similar fashion locking element 96 on the panel 82 is staggered from side to side and the undercut receptacle 94 on the opposite panel is similarly configured to receive the staggered male element therein in a locking relationship. Conventional undercuts are used to insure a snap fit in both locking mechanisms and holes 106 and 108 are formed in the panel to receive all of the elements of the locking tabs.

Figure 24:
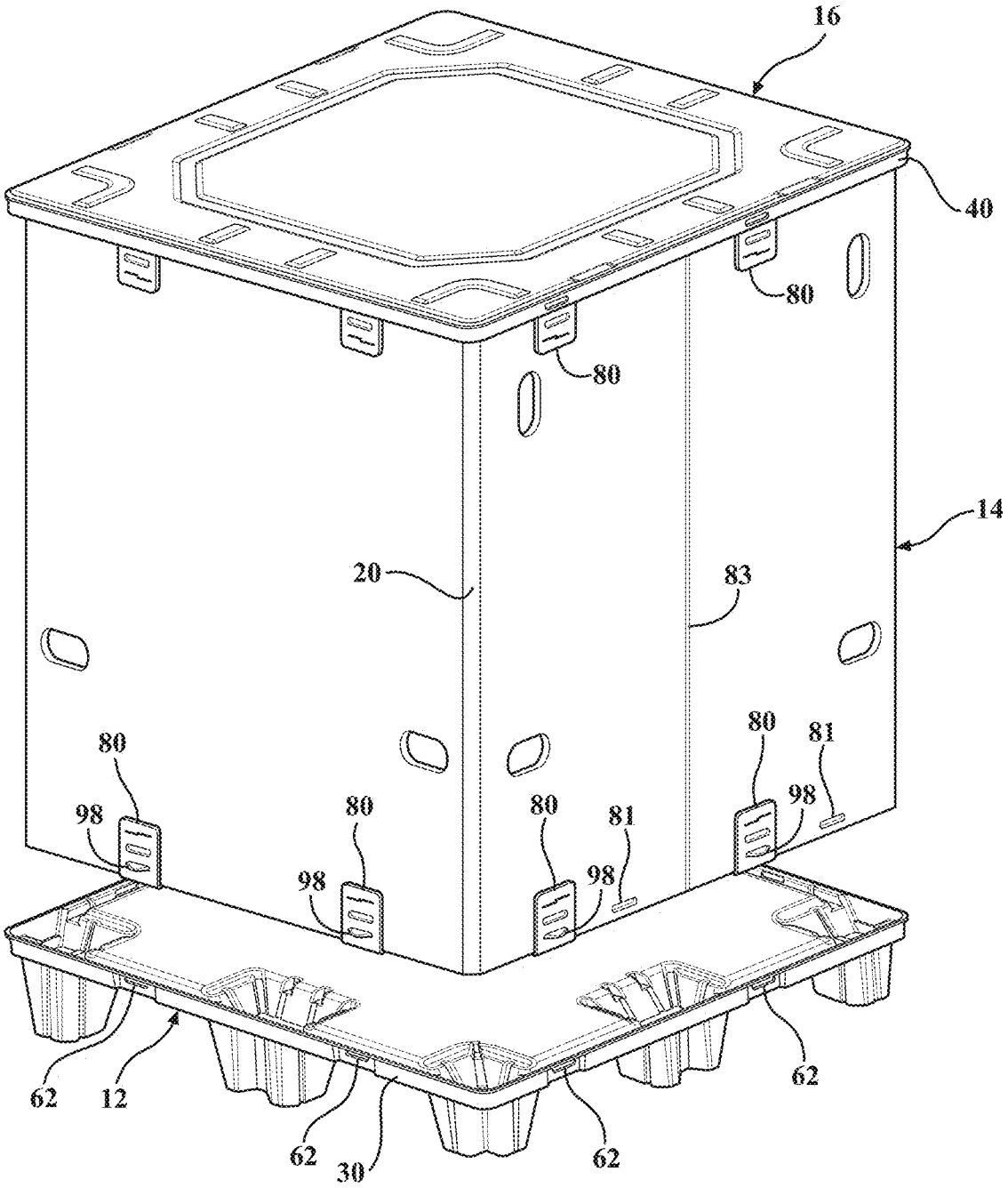
FIG. 24 is a perspective view of the complete container with the sleeve separated from the pallet and the cover fully installed.
Figure 25:
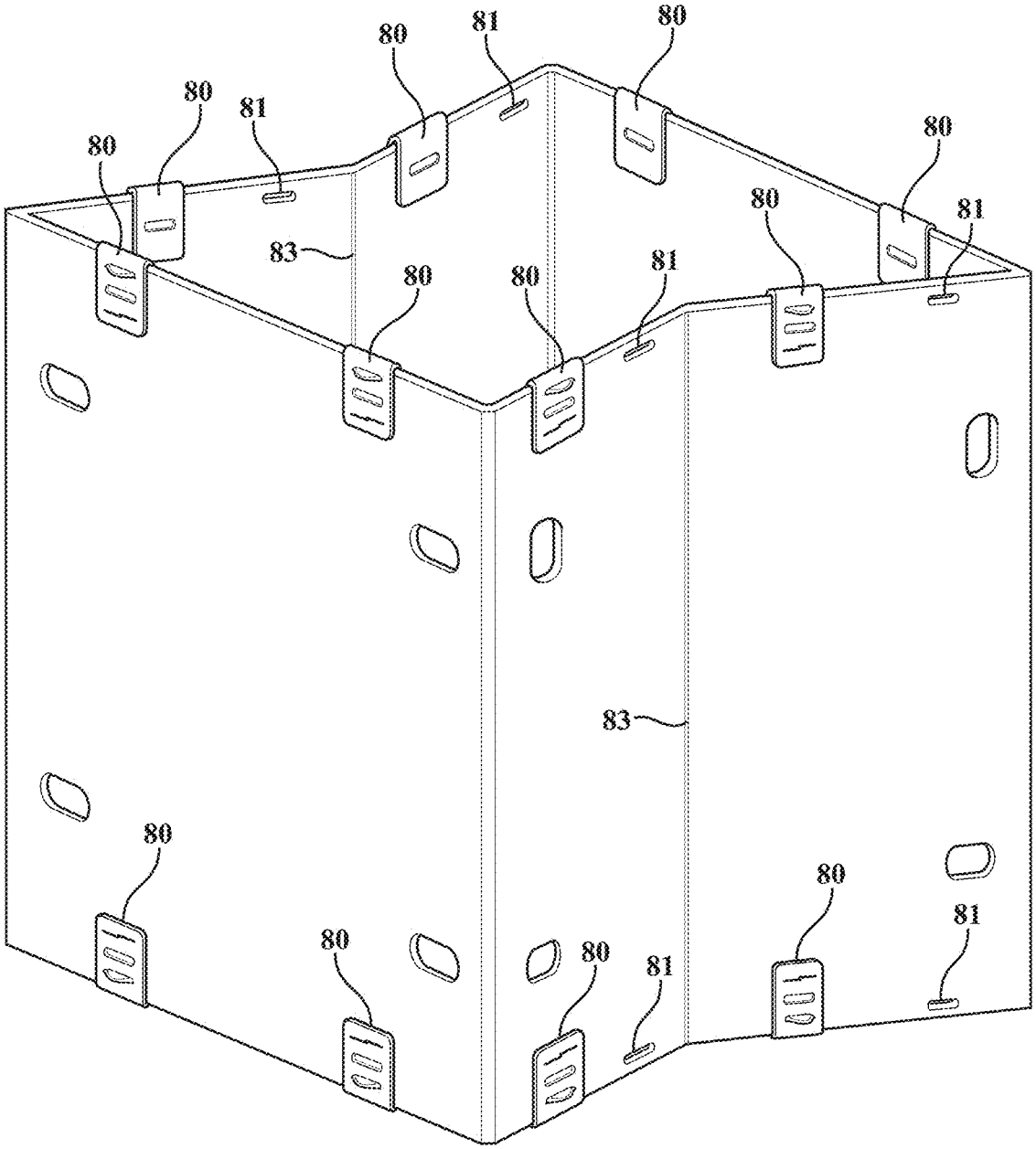
FIG. 25 is a perspective view of an accordion folding sleeve.
Figure 26:
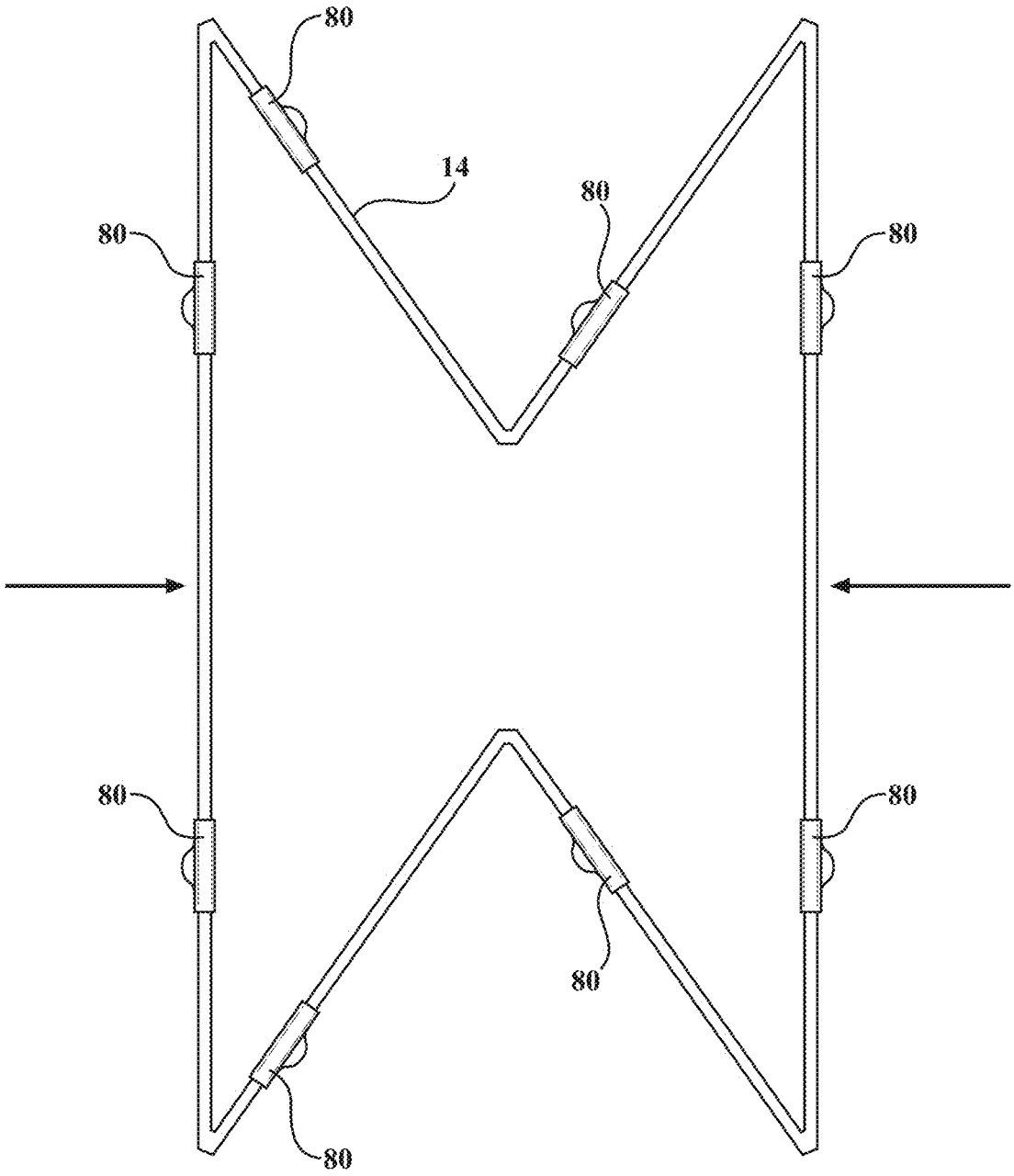
FIG. 26 is a diagrammatic view of the folding sleeve.

As shown in FIGS. 24-26, it is desirable to be able to fold the sleeve 14 flat for storage or return shipment. To accomplish this, inwardly folding hinge lines 83 are formed in two opposite sleeve panels and the sleeve can thus fold "accordion-style" as shown in FIG. 26.

To ensure that the outwardly-protruding tabs of the clips 80 on these inwardly-foldable panels do not collide and prevent full-folding, the clips 80 on the accordion-fold panels are offset from center and slots 81 are provided to receive the tab of the clip 80 on the adjacent panel when fully folded. A similar arrangement is made for the cover 16.

Although the most common arrangement is to have eight locks on each of the pallet-sleeve combination and the cover-sleeve combination, with two clips on each of the top and bottom sleeve panel edges, various alternative arrangements are possible. For example, the cover may have locks only on two panels as shown in FIG. 24.

Figure 22:
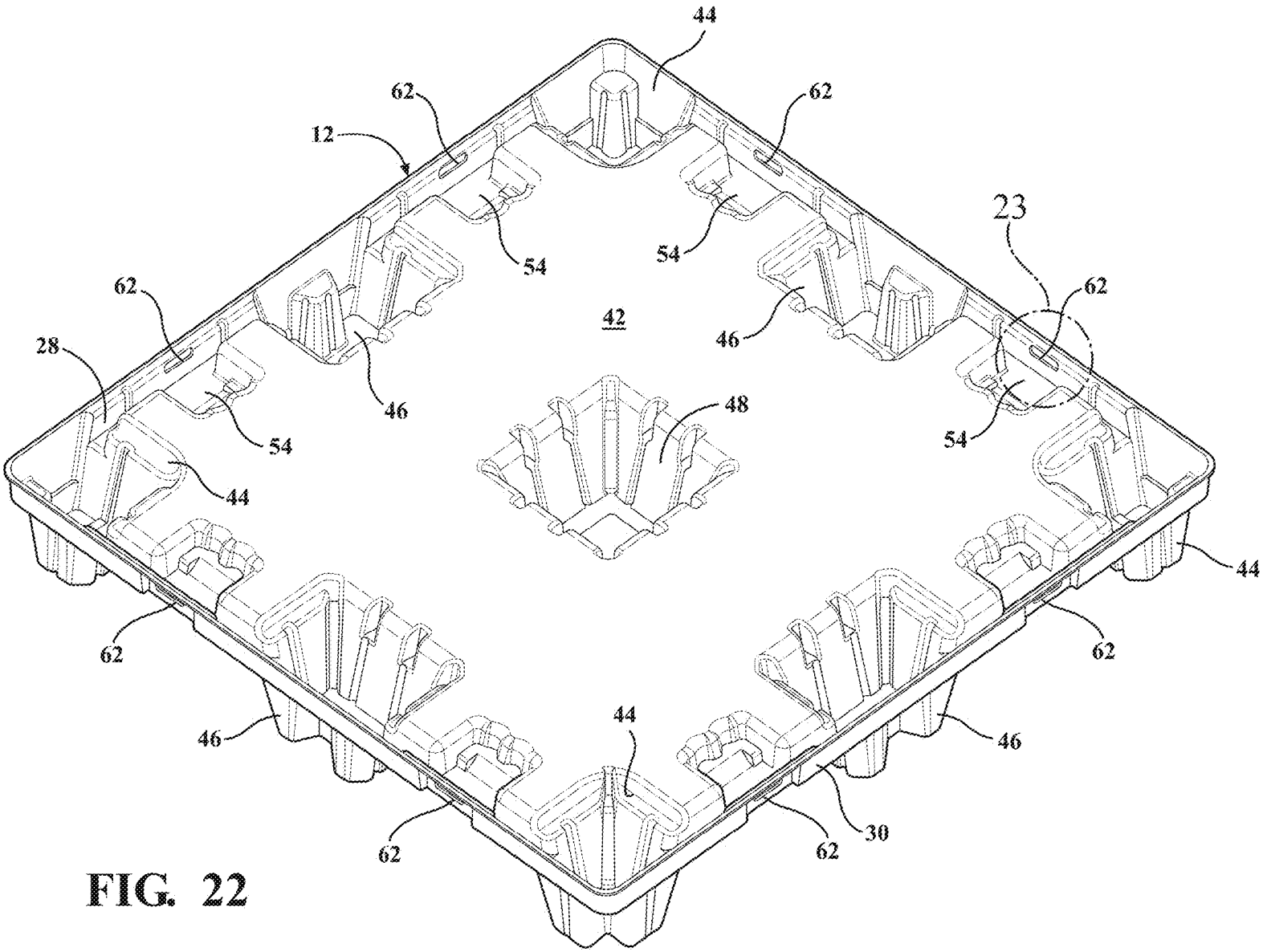
FIG. 22 is a perspective view of the top surface of a pallet adapted to receive the sleeve with clip tabs.

Assembly of the clips to the sleeve 102 is reasonably simple; i.e. the three necessary slots are formed in the sleeve 102 at every location where a lock is to be provided; e.g., there will be two sets of such slots on each of the faces or sides of the sleeve. The clips are folded and locked together with the sleeve material 102 sandwiched between them and with the locking tab 96 formed on the outside surface of panel 84 pointing in the direction of an aperture 62 in, for example, the pallet side wall is shown in FIG. 22. After all of the clips have been installed, the sleeve can be inserted into the peripheral groove of the pallet with the tabs 96 fitting into the apertures 62 in the outer peripheral rim or wall of the pallet to lock them elements together. Again, there can be a relief or a slight widening of the groove opposite the aperture 62 formed in the interior deck of the pallet.

A similar arrangement is provided for the cover, i.e., the cover receives the top edge of the sleeve inside of the rim with the clips providing tabs that snap into apertures in the outside rim. It is important that the sleeve edge fully contact the cover inside surface as shown in FIG. 9 so stacking of containers does not impose a vertical load on the tab lock.

By way of summary, a passive locking mechanism between a container sleeve and both the pallet and cover of a three-part container is provided. In all cases the locking mechanism is provided by means of sets of protruding tabs and either pocket or apertures in the opposite member which receive those tabs. In one embodiment the tabs are formed in the pallet and cover and slots to receive the tabs are formed in a simple fashion along the top and bottom edges of the sleeve.

In the second and preferred embodiments the tabs are provided by means of foldable plastic clips that lock on to the interior and outside surfaces of the sleeve walls at various locations, preferable two spaced apart locations on the top and bottom edges of the sleeve panels. In these embodiments, simple apertures are provided in the outside rim or wall of the pallet and the outside wall of the cover to receive the tabs therein. The tabs or clips containing the tabs snap lockingly on to the sleeve sidewalls and essentially reinforce the slots in the sleeve to prevent tearing. In all embodiments, the tab locks do not engage until the sleeve edges are fully inserted; i.e., the sleeve edge "bottoms out" on the floor of the pallet groove and the top of the cover deck.

It is to be understood that the invention has been described with respect to illustrative embodiments and that various modifications thereto may be made to accommodate size and material requirements and the like without departing from the sprit and scope of the invention as defined in the appended claims.

What is claimed:

1. A one-piece molded plastic clip for passively connecting a container sleeve to a pallet base and/or cover comprising:

first and second panels of generally similar geometry joined by an integral double hinge section to allow the panels to be folded into a mounting condition wherein each panel has inner and outer parallel surfaces;

a protruding locking tab feature formed integrally with one of the panels and protruding from an outside surface thereof; and means for locking the two panels together by folding the two panels into parallel proximity wherein said means comprises a first complemental locking element on the inner surface of one panel and a second complemental element on the inner surface of a second panel directly opposite said first locking element; said elements being configured to passively lock together when the panels are placed in the folded condition.

2. The clip defined in claim 1 further including a sleeve wherein said first locking element extends through a hole in and adjacent an edge of said sleeve to secure said clip to said sleeve; said means for locking further comprises a second complemental set of locking elements on respective inside panels that extend through a second hole in said sleeve when mounted thereon in the folded condition.

3. The combination of claim 2 wherein the sleeve has four walls; at least two opposite walls having centered vertical reverse hinges such that the sleeve may be collapsed accordion style.

4. The combination of claim 2 wherein the sleeve has four walls integrally joined by hinges; at least two opposite walls having centered vertical reverse hinges such that the sleeve may be collapsed accordion style.

5. A container assembly comprising:

a four-sided pallet base, a sleeve having multiple hinge-connected walls each with a bottom edge; and a set of one-piece molded plastic clips as defined in claim 1 joined to two opposite sleeve walls adjacent the bottom edges and adapted to passively join the sleeve to the pallet base wherein;

the pallet base comprises feet, a loading deck and a four-sided outer rim defining a groove between the rim and the deck wherein said rim has formed therein in at least two spaced apart slotted apertures;

said clips being attachable to the sleeve at spaced locations along the bottom edge which locations are co-located with said slotted apertures thereby to allow said tabs to be forceably inserted into said slotted apertures to passively secure the sleeve to the pallet base when the sleeve is substantially fully inserted into the pallet groove.

6. The combination of claim 5 wherein the tabs are wedge shaped to provide a cam action during insertion of the sleeve into the pallet groove; said one piece clips being the sole structural elements needed to join the sleeve to the base.

7. The combination set forth in claim 5 further comprising a four-sided cover adapted to fit atop said sleeve; and means for securing said cover to said sleeve.

8. The clip defined in claim 1 wherein the protruding locking tab is wedge shaped.

9. The clip as defined in claim 1 wherein the first complemental locking element is a male barb.

10. A clip for creating a passive lock between a container sleeve and a second structure comprising;

a one-piece molded plastic body having two generally planar panels integrally joined at one end by a double hinge that allows said panels to be folded into a parallel spaced apart condition to define for each panel inner and outer parallel surfaces in the folded condition;

a protruding tab feature integrally formed on the outer surface of one panel at a first distance from the double hinge; and a set of first and second complemental locking features integrally formed on respective inner surfaces of the panels for passively snap locking the panels together;

said set being located at a second distance from the double hinge that is the different from the first distance; and a stabilizing protrusion formed on the inner surface one of said panels between the protruding tab feature and the locking features, wherein said locking features and stabilizing protrusion extend through respective spaced apart holes in a sleeve when said clip is mounted thereon.

11. A device as defined in claim 10 wherein the stabilizing protrusion has a height normal to the panel surface on which it is located approximating the distance between said panels in the folded condition.

12. A device as defined in claim 10 further including a second set of first and second complemental locking features on the inner surfaces of the panels for snap locking the panels together;

said second set being located at said first distance wherein one of said second set of features is essentially co-located with said protruding tab feature.

13. A device as defined in claim 12 further including an aperture on an inner panel opposite said stabilizing protrusion and aligned with said stabilizing protrusion when the panels are in the folded condition.

14. The combination defined in claim 3 where a top surface of said tab feature is sloped to produce a cam action facilitating removal of said sleeve from said pallet base.

15. A molded plastic clip for passively connecting a multi-walled container sleeve to a pallet-base comprising:

first and second panels of generally similar geometry joined by an integral double hinge to allow the panels to be folded together into a mounting condition with a sleeve wall between said panels;

first and second complemental and passive locking elements integrally formed on inside surfaces of respective panels passively snap locking said panels together in said mounting condition, said sleeve having apertures for receiving said elements therethrough, and tab means integrally formed on an outside surface of one of said panels for passively attaching said sleeve with clips in said mounting condition to a pallet base.

* * * * *